US006743299B1

(12) United States Patent
Barton et al.

(10) Patent No.: US 6,743,299 B1
(45) Date of Patent: Jun. 1, 2004

(54) METHOD OF CLEANING INFANT FEEDING BOTTLES

(76) Inventors: Tony M. Barton, 2620 St. Philip St., New Orleans, LA (US) 70115; Ilene Cousin, 2620 St. Philip St., New Orleans, LA (US) 70115

( * ) Notice: Subject to any disclaimer, the term of this patent is extended or adjusted under 35 U.S.C. 154(b) by 0 days.

(21) Appl. No.: 10/463,169

(22) Filed: Jun. 17, 2003

(51) Int. Cl.[7] ..... B08B 7/00; B08B 9/08

(52) U.S. Cl. ..... 134/7; 134/22.1; 134/22.11; 134/22.13; 134/22.16; 134/22.17; 134/23; 134/25.2

(58) Field of Search ..... 134/7, 22.1, 22.11, 134/22.13, 22.16, 22.17, 23, 25.2

(56) References Cited

U.S. PATENT DOCUMENTS

| | | | | | |
|---|---|---|---|---|---|
| 5,425,385 | A | * | 6/1995 | Kuta et al. | 134/48 |
| 5,435,036 | A | * | 7/1995 | Hedrick et al. | 15/59 |
| 5,903,944 | A | * | 5/1999 | Burrell | 15/65 |
| 6,616,771 | B2 | * | 9/2003 | Osborne et al. | 134/18 |

* cited by examiner

*Primary Examiner*—Zeinab El-Arini
(74) *Attorney, Agent, or Firm*—Keaty Professional Law Corporation

(57) ABSTRACT

A method of cleaning articles, such as infant feeding bottles is disclosed. The method provides for the use of alkali metal chloride, more particularly sodium chloride. The salt is deposited into the article to be cleaned, then water is added, and then the article is shaken to cause the crystalline substance to contact the interior walls of the container, thereby cleaning and sanitizing the interior of the article.

7 Claims, No Drawings

METHOD OF CLEANING INFANT FEEDING BOTTLES

BACKGROUND OF THE INVENTION

The present invention relates to household cleaning and more particularly, to cleaning of infant feed bottles and similar containers. This invention may also be utilized for cleaning other articles, such as glasses, vases, carafes, and other difficult to clean items.

Every person who has been faced with the problem of thorough cleaning of narrow container, such as baby bottles, glasses, and narrow vases readily recognizes the difficulty of dislodging any dried-up residue in narrow crevices of the container. Another often-encountered problem relates to sanitizing of the container and removing odor-causing bacteria. Sometimes, visually clean articles will continue to carry odors. Such occasions are encountered with flower vases where water became stagnant and microbial activity developed due to plant decomposition.

Infant feeding bottles present a special problem. In many cases, merely cleaning the articles with a soapy cleaning agent is not sufficient since liquid baby food contains fatty liquids and suspended solids, such as cereal. In such cases, the user has to resort to brushes for lifting and removing dried-up solids that deposited on the interior wall of the infant fee bottle. In such cases, special brushes must be used. The abrasive action of the brush helps in removing impurities from the inside of the bottle that cannot be removed by simply agitating cleaning liquid in the bottle.

Many commercially available cleaning products containing soaps have a detergent action for removal of grease and dirt from the surface of various articles. Some of the commercial detergents also claim germicidal action capable of destroying bacteria and other odor-causing organisms on the surfaces of the cleaned articles. While these cleaner may be safe for use of general use articles, it is preferred that baby bottles be cleaned with a safe and effective cleaner that would eliminate pathogenic organisms, while at the same time remove dry and fatty deposits from the walls of the baby bottles.

The present invention contemplates provision of a method of cleaning various articles that may be used in food service, as well as articles that may require scrubbing for removal of impurities adhering to the walls of the articles.

SUMMARY OF THE INVENTION

It is, therefore, an object of the present invention to provide a method of cleaning articles used in infant feeding and care.

It is another object of the present invention to provide a method of cleaning articles using non-toxic composition that cleans surfaces of the article by removing fatty deposits, dirt, and other impurities in an efficient manner.

It is a further object of the present invention to provide a method of cleaning articles that utilizes an easy to obtain and inexpensive cleaner, while at the same time sanitizing the article.

These and other objects of the present invention are achieved through a provision of a method of cleaning interior of a container by using an alkali metal chloride, and more particularly sodium chloride. Sodium chloride is a safe substance; it is used in cooking, as a taste enhancing substance, in food preservation, etc. Sodium chloride is a crystalline substance, it is stable, water-soluble with solubility in water 35.7 g/100 g at 0 degrees Centigrade, with a specific gravity of 2.1–2.6.

When mixed with cold or lukewarm water, sodium chloride does not immediately dissolve. The present invention takes advantage of this phenomenon by providing a method of cleaning articles, such as infant feed bottles, by depositing a pre-determined amount of sodium chloride in the container and then adding a pre-determined amount of water into the container. The container is then vigorously agitated, causing the non-dissolved salt crystals to contact the walls of the bottle and dislodge any impurities that have settled on the walls. At the same time, fatty substances and odor-causing bacteria are removed.

Continuous agitation of the infant feeding bottle will eventually cause substantially all salt to be dissolved. However, it is necessary to continue agitation until this point. The user may then rinse the infant feed bottle and sterilize the bottle in the usual manner.

The same steps are used for cleaning other articles, such as vases, bottles, carafes, etc.

In the preferred embodiment, the ratio of salt to water is 1:1.5–1;2. If desired, one or two drops of food coloring agent may be added to the mixture of salt and water in the container.

DETAILED DESCRIPTION OF THE PREFERRED EMBODIMENT

The cleaning method of the present invention provides for the use of alkali metal chloride, more specifically sodium chloride, a commonly available substance often referred to as common salt, natural salt, or table salt. Sodium chloride is a colorless crystal having a specific gravity of 2.1–2.6. Sodium chloride is water soluble, with solubility of 35.7 g/100 g at 0 degrees Centigrade. Sodium chloride is readily available, inexpensive substance; it may be purchased in the form of ultra-fine table salt, rock salt, and coarse salt.

The proportion in which the salt is mixed in the method of the present invention with water is important for achieving the desired abrasive result during agitation. In the preferred embodiment, the ratio of salt to water was selected to be 1:15.5 to 1:2.

During tests, two ounces of salt, preferably coarse salt, were mixed with 3–4 ounces of cold or lukewarm water. In the more preferred embodiment, the cleaning composition is made with two ounces of coarse salt with three ounces of water. The method of the present invention includes a step of depositing of the pre-determined amount of salt inside a container to be cleaned. Then pre-determined amount of cold or lukewarm water is then poured into the container. The next step involves vigorous agitation of the mixture inside the container.

The container is shaken before the salt deposited in the container is allowed to dissolve. Some portion of the salt becomes dissolved during the shaking of the bottle, while the remainder of the crystals are forced to contact the inside walls of the container, scrubbing the walls and causing the impurities to separate from the walls of the container. The agitation of the container may be continued, if desired even after all salt has been dissolved to further dislodge and suspend fatty molecules.

Sodium chloride has sanitizing qualities that help provide anti-microbial activity, reducing and arresting the growth of bacteria and fungi. The composition used in the method of the present invention removes and dissolves gritty substances, releases food deposits, such as traces of cereal, from the walls of the baby bottle and removes odors by absorbing the odor-producing substances trapped in the crevices of the container inner walls.

The method of the present invention produces a kind of "sandblasting" activity on the surfaces of the baby bottle, allowing the cleaning crystals to reach the surfaces that are difficult to clean using conventional brushes. Since sodium chloride is safe for human consumption, when used in small quantities, the method of the present invention, utilizing the safe cleaning material requires no special handling or precautions.

Should the user detect the presence of residual impurities in the container or the article to be cleaned, the user may repeat the cleaning cycle by depositing sodium chloride, then water, and shaking of the article until the article appears to be cleaned. If the article to be cleaned is an infant feeding utensil, the user may want to optionally sterilize the article in boiling water. If the article is not intended for use in food consumption, the article may be considered cleaned once the impurities have been removed such as not to be visible on the walls of the container and once the user does not detect an objectionable odor.

During tests, the method of the present invention was used for removal of spoiled milk, the remains of baby formula, dried baby cereal and other such substances. During tests, one or two cycles of the method of the present invention were sufficient to achieve the desired goal. The second cycle of the cleaning method of the present invention was sometimes needed to remove old dried-up substances from the article.

If desired, a food-coloring agent may be added to the water solution. In the test performed, 1–2 drops of the conventional food coloring was sufficient to color the cleaning medium.

Many changes and modifications can be made in the method of the present invention without departing from spirit thereof. We therefore pray that our rights to the present invention be limited only by the scope of the appended claims.

We claim:

1. A method of cleaning infant feeding bottles, comprising the steps of:

(a) depositing one part by weight of sodium chloride in crystal form in an infant feeding bottle;

(b) depositing between one and one half parts to two parts by weight of water in the infant feeding bottle;

(c) immediately initiating shaking of the infant feeding bottle, causing contact of the sodium chloride with interior walls of the infant feeding bottle, thereby dislodging and dissolving impurities deposited on the interior walls of the infant feeding bottle.

2. The method of claim 1, wherein the water deposited in the infant feeding bottle is retained at ambient temperature.

3. The method of claim 1, further comprising the step of repeating steps from (a) to (c) until substantially all impurities are removed from interior of the infant feeding bottle.

4. A method of cleaning and sanitizing infant feeding bottle, comprising the steps of:

depositing a pre-determined amount of sodium chloride in crystal form into the infant feeding bottle, depositing a pre-determined amount of water at ambient temperature into the infant feeding bottle;

vigorously shaking the infant feeding bottle, while at least a portion of the sodium chloride remains non-dissolved in water, thereby causing abrasive action on foreign particles adhering to interior wall of the infant feeding bottle, while dissolving fatty substances present in the infant feeding bottle and sanitizing interior of the infant feeding bottle.

5. The method of claim 4, wherein sodium chloride and water are deposited in a ratio of 1:1.5.

6. The method of claim 4, wherein sodium chloride and water are deposited in a ratio of 1:2.

7. The method of claim 4, wherein the step of shaking the infant feeding bottle is performed immediately after the step of depositing water into the infant feeding bottle containing a pre-determined amount of sodium chloride, while at least a portion of sodium chloride remains non-dissolved in the infant feeding bottle.

* * * * *